US012253312B2

(12) United States Patent
Chatani et al.

(10) Patent No.: US 12,253,312 B2
(45) Date of Patent: Mar. 18, 2025

(54) HEAT EXCHANGER

(71) Applicant: DENSO CORPORATION, Kariya (JP)

(72) Inventors: Shota Chatani, Kariya (JP); Hiroshi Hamada, Kariya (JP); Mitsugu Nakamura, Kariya (JP); Tomohiko Nakamura, Kariya (JP); Ichio Kamei, Kariya (JP)

(73) Assignee: DENSO CORPORATION, Kariya (JP)

( * ) Notice: Subject to any disclaimer, the term of this patent is extended or adjusted under 35 U.S.C. 154(b) by 130 days.

(21) Appl. No.: 17/866,742

(22) Filed: Jul. 18, 2022

(65) Prior Publication Data

US 2022/0349655 A1 Nov. 3, 2022

Related U.S. Application Data

(63) Continuation of application No. PCT/JP2020/049068, filed on Dec. 28, 2020.

(30) Foreign Application Priority Data

Jan. 20, 2020 (JP) ..... 2020-006901

(51) Int. Cl.

| | |
|---|---|
| ***F28F 9/02*** | (2006.01) |
| ***F28D 1/053*** | (2006.01) |
| ***F28F 1/12*** | (2006.01) |
| ***F28F 9/18*** | (2006.01) |

(52) U.S. Cl.

CPC ..... *F28D 1/05391* (2013.01); *F28F 1/128* (2013.01); *F28F 9/0209* (2013.01); *F28F 9/182* (2013.01); *F28F 2220/00* (2013.01)

(58) Field of Classification Search

CPC ..... F28F 9/0265; F28F 9/0278; F28F 9/0282; F28F 9/182

See application file for complete search history.

(56) References Cited

U.S. PATENT DOCUMENTS

2008/0029254 A1* 2/2008 Sekito ..... F28F 9/026 165/148
2012/0267086 A1 10/2012 Yanik et al.

FOREIGN PATENT DOCUMENTS

FR 3056734 A1 * 3/2018 ..... F28F 1/025
JP 4830918 B2 12/2011
WO 2019111735 6/2019
WO WO-2020/012921 A1 1/2020

* cited by examiner

*Primary Examiner* — Eric S Ruppert
(74) *Attorney, Agent, or Firm* — Harness, Dickey & Pierce, P.L.C.

(57) ABSTRACT

A heat exchanger includes tubes arranged side by side, and a tank connected to ends of the tubes. The heat exchanger performs heat exchange between a first fluid flowing inside the tubes and a second fluid flowing outside the tubes. The heat exchanger includes a closing member disposed inside the tank and partially closing an opening provided at an end of a predetermined tube that is at least one of the tubes. The predetermined tube has a protrusion formed at the end of the predetermined tube. The closing member has an avoiding structure that avoids interference between the protrusion and the closing member.

9 Claims, 10 Drawing Sheets

HEAT EXCHANGER

CROSS REFERENCE TO RELATED APPLICATIONS

The present application is a continuation application of International Patent Application No. PCT/JP2020/049068 filed on Dec. 28, 2020, which designated the U.S. and claims the benefit of priority from Japanese Patent Application No. 2020-006901 filed on Jan. 20, 2020, the entire disclosure of which is incorporated herein by reference. The entire disclosures of all of the above applications are incorporated herein by reference.

TECHNICAL FIELD

The present disclosure relates to a heat exchanger.

BACKGROUND

A heat exchanger includes a heat exchange core, an inlet tank and an outlet tank.

SUMMARY

According to at least one of embodiment, a heat exchanger includes tubes arranged side by side, and a tank connected to ends of the tubes. The heat exchanger performs heat exchange between a first fluid flowing inside the tubes and a second fluid flowing outside the tubes. The heat exchanger includes a closing member disposed inside the tank and partially closing an opening provided at an end of a predetermined tube that is at least one of the tubes. The predetermined tube has a protrusion formed at the end of the predetermined tube. The closing member has an avoiding structure that avoids interference between the protrusion and the closing member.

BRIEF DESCRIPTION OF THE DRAWINGS

The details of one or more embodiments are set forth in the accompanying drawings and the description below. Other features and advantages will be apparent from the description and drawings, and from the claims.

DETAILED DESCRIPTION

Figure 1:
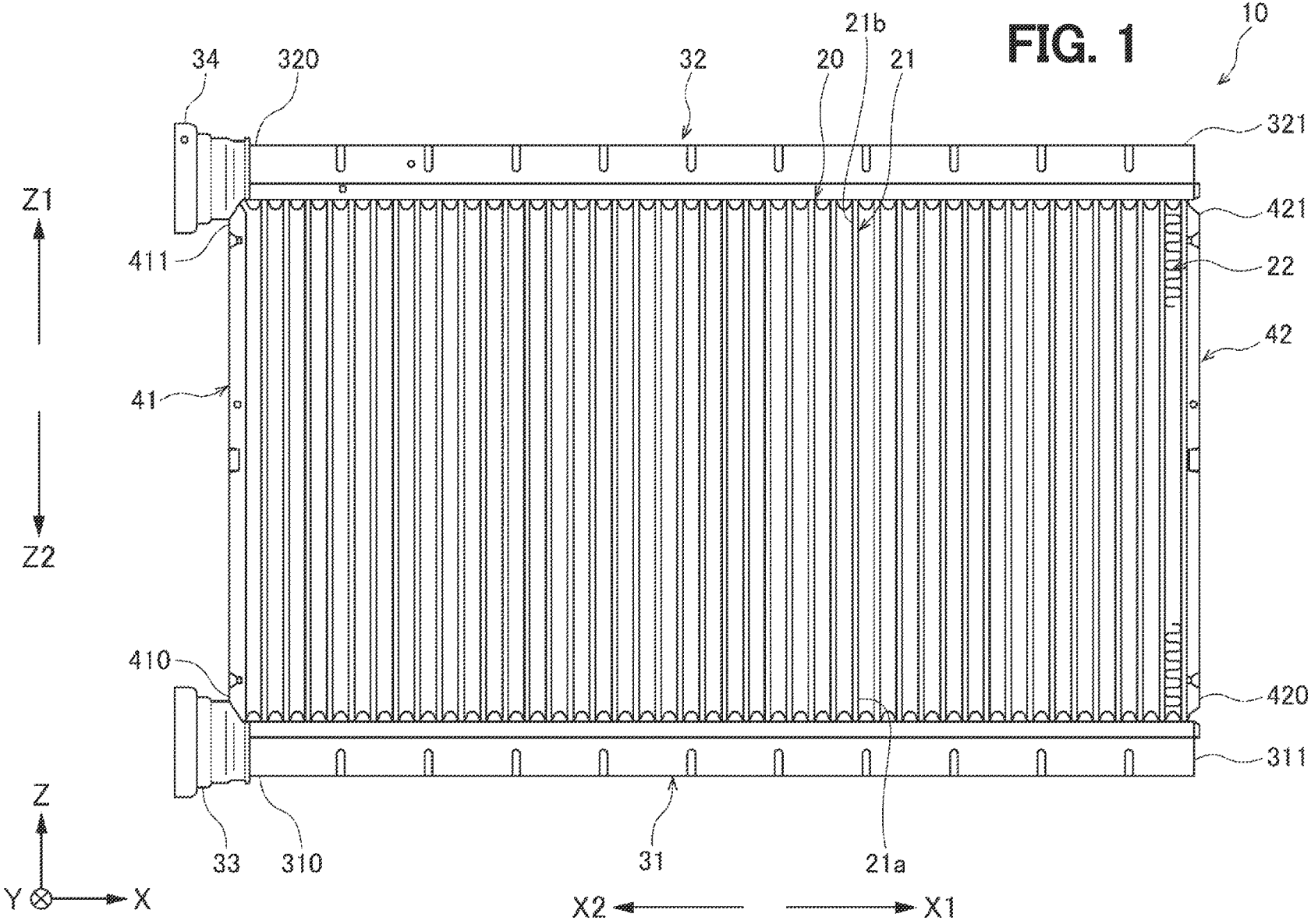
FIG. 1 is a front view illustrating a front structure of a heat exchanger of a first embodiment.

To begin with, examples of relevant techniques will be described.

A heat exchanger according to an example includes a heat exchange core, an inlet tank and an outlet tank. The heat exchange core is formed by stacking tubes through which an internal fluid flows. One ends of the tubes are inlet ends and the other ends are outlet ends. The inlet tank is joined to the inlet ends of the tubes such that an inside of the inlet tank communicates with insides of the tubes. The inlet tank distributes the internal fluid to the tubes. The outlet tank is joined to the outlet ends of the tubes such that an inside of the outlet tank communicates with the inside of the tubes. The outlet tank collects the internal fluid therein from the tubes. An end of the inlet tank in a tube stacking direction has an inflow port to allow the internal fluid to flow into the inlet tank. An end of the outlet tank in the tube stacking direction has an outlet port facing in the same direction as a direction in which the inlet port faces. The outlet port allows the internal fluid to flow out of the outlet tank. A closing member is provided at ends of a predetermined number of tubes adjacent to the inflow port in the tube stacking direction. The closing member partially closes openings provided at the ends of the predetermined number of tubes. According to such a configuration, the closing member can reduce flow rates of the internal fluid flowing into the tubes arranged near the inflow port, while the closing member can increase flow rates of the internal fluid flowing into tubes arranged away form the inflow port. As a result, it is possible to equalize the flow rates in the tubes.

A protrusion may be formed at an end of a tube in such heat exchanger. Specifically, the tube is manufactured by bending a metal plate into a tubular shape, joining both ends of the metal plate to each other, and then cutting the metal plate into a predetermined length. When the tube is manufactured in this way, a burr can be formed on a cut surface at the time of cutting the tubular product. It is confirmed by the inventors of the present disclosure that the burr formed at the time of cutting is likely to be formed particularly at the joint of both ends of the metal plate. The burr or the like formed in this way may form the protrusion at the end of the tube.

If the protrusion is formed at the end of the tube, the closing member may be lifted by the protrusion of the tube at the time of placing the closing member at the end of the tube. If the closing member is lifted by the protrusion of the tube, it will become difficult for the closing member to close an opening of the tube. Further, for example, variations in protruding length of the end of the tube may also make it difficult for the closing member to close the end of the tube. When the effect of closing the end of the tube by the closing member is reduced by these various factors, it becomes difficult to reduce a flow rate of fluid flowing into the tube near the inflow port, and as a result, equality of distribution of the fluid in the tubes may not be improved.

In contrast, according to one aspect of the present disclosure, a heat exchanger includes tubes arranged side by side, and a tank connected to ends of the tubes. The heat exchanger performs heat exchange between a first fluid flowing inside the tubes and a second fluid flowing outside the tubes. The heat exchanger includes a closing member disposed inside the tank and partially closing an opening provided at an end of a predetermined tube that is at least one of the tubes. The predetermined tube has a protrusion formed at the end of the predetermined tube. The closing member has an avoiding structure that avoids interference between the protrusion and the closing member.

According to this configuration, the avoiding structure formed in the closing member can avoid interference between the protrusion formed at the end of the predetermined tube and the closing member. Thus, it becomes difficult for the closing member to be lifted by the protrusion. As a result, the end of the predetermined tube can be more certainly closed by the closing member, so that the equality of distribution of the fluid in the tubes can be improved.

Hereinafter, an embodiment of a heat exchanger will be described with reference to the drawings. To facilitate understanding, identical constituent elements are assigned identical symbols in the drawings, and the duplicate descriptions on those will be omitted.

First Embodiment

First, a heat exchanger 10 according to a first embodiment shown in FIG. 1 will be described.

The heat exchanger 10 of the present embodiment is used, for example, as a heater core of an air conditioner mounted on a vehicle. The air conditioner is a device that heats or cools an air and blows the air into a vehicle compartment, thereby heating or cooling the vehicle compartment. The heat exchanger 10 is disposed in an air conditioning duct through which air-conditioning air flows. A cooling water of an engine of the vehicle circulates inside the heat exchanger 10 in a liquid phase. The heat exchanger 10 heats the air-conditioning air by exchanging heat between the cooling water flowing through the heat exchanger 10 and the air-conditioning air flowing through the air conditioning duct. The air-conditioning air heated at the heat exchanger 10 is blown into the vehicle compartment through the air conditioning duct, thereby heating the vehicle compartment. In this embodiment, the cooling water flowing inside the heat exchanger 10 corresponds to a fluid. Further, the cooling water corresponds to a first fluid, and the air corresponds to a second fluid.

As illustrated in FIG. 1, the heat exchanger 10 includes a core 20, tanks 31, 32 and side plates 41, 42. The heat exchanger 10 is made of a metal material such as an aluminum alloy.

The core 20 performs heat exchange between the cooling water and the air. The core 20 has tubes 21 and fins 22. The tubes 21 are stacked with each other in a direction indicated by an arrow X in the drawings at predetermined intervals. The fins 22 are arranged in gaps defined between adjacent ones of the tubes 21. FIG. 1 shows a part of the fins 22. In the core 20, the air flows in a direction indicated by an arrow Y in the drawings. The direction indicated by the arrow Y is a direction perpendicular to the direction indicated by the arrow X. A direction indicated by an arrow Z in the drawings is a direction perpendicular to the direction indicated by the arrow X and the direction indicated by the arrow Y.

Hereinafter, the direction indicated by the arrow X is referred to as a "tube stacking direction X". Further, one direction in the tube stacking direction X is referred to as a "X1 direction", and the other opposite direction in the tube stacking direction X is referred to as a "X2 direction". Further, the direction indicated by the arrow Y is referred to as an "air flow direction Y".

Figure 2:
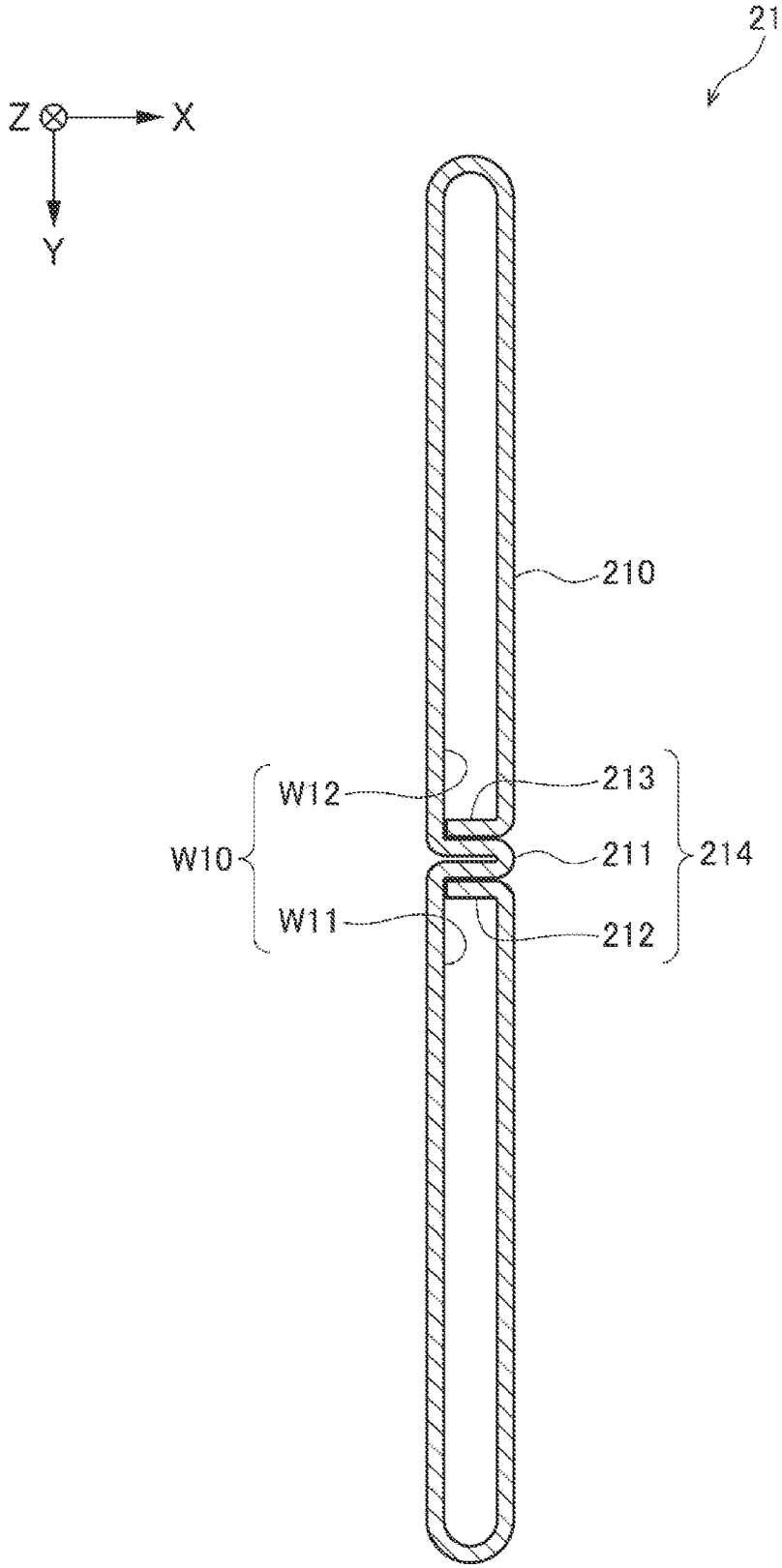
FIG. 2 is a cross-sectional view illustrating a cross-sectional structure of tubes of the first embodiment.

The tubes 21 are provided to extend in the direction indicated by the arrow Z in the drawings. Hereinafter, the direction indicated by the arrow Z is referred to as a "tube longitudinal direction Z". Further, one direction in the tube longitudinal direction Z is referred to as a "Z1 direction", and the other opposite direction in the tube longitudinal direction Z is referred to as a "Z2 direction". As shown in FIG. 2, each tube 21 of the tubes 21 has an inner passage W10 through which the cooling water flows. The tube 21 is formed by bending a metal plate 210 into a tubular shape.

Specifically, when manufacturing the tube 21, first, a central portion of the metal plate 210 having a flat shape is doubly bent to have a folded portion forming a protruding portion 211. Then, both ends 212, 213 of the metal plate 210 are bent inward such that the both ends contact with the protruding portion 211. And then, the both ends 212, 213 and the protruding portion 211 are joined by brazing, whereby a tubular product is formed. The tube 21 is finally formed by cutting the tubular product to a predetermined length. In the tube 21 of the present embodiment, an inner passage W10 of the tube 21 is divided into two flow paths W11, W12 by a joint 214 at which the both ends of the metal plate 210 and the protruding portion 211 are joined.

As shown in FIG. 1, each fin 22 of the fins 22 is so-called corrugated fin formed by bending a thin and long metal plate into a wavy shape. Bent portions of the fin 22 are joined to outer walls of adjacent two tubes 21, 21 by brazing. The fin 22 improves a heat exchange efficiency between the cooling water and the air by increasing a heat transfer area for air.

Figure 3:
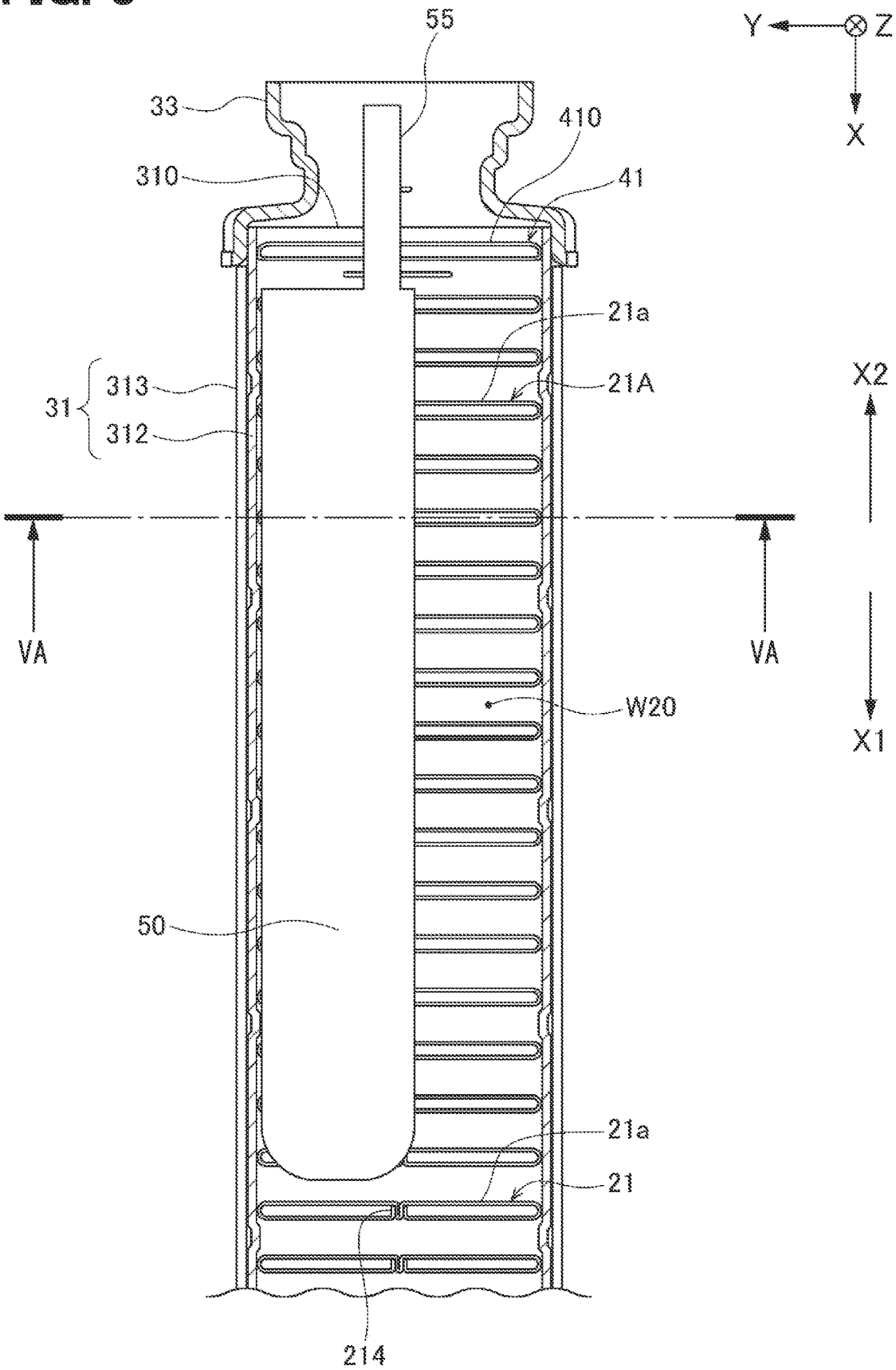
FIG. 3 is a cross-sectional view illustrating a cross-sectional structure of a first tank on a cross section orthogonal to a tube longitudinal direction, according to the first embodiment.
Figure 4:
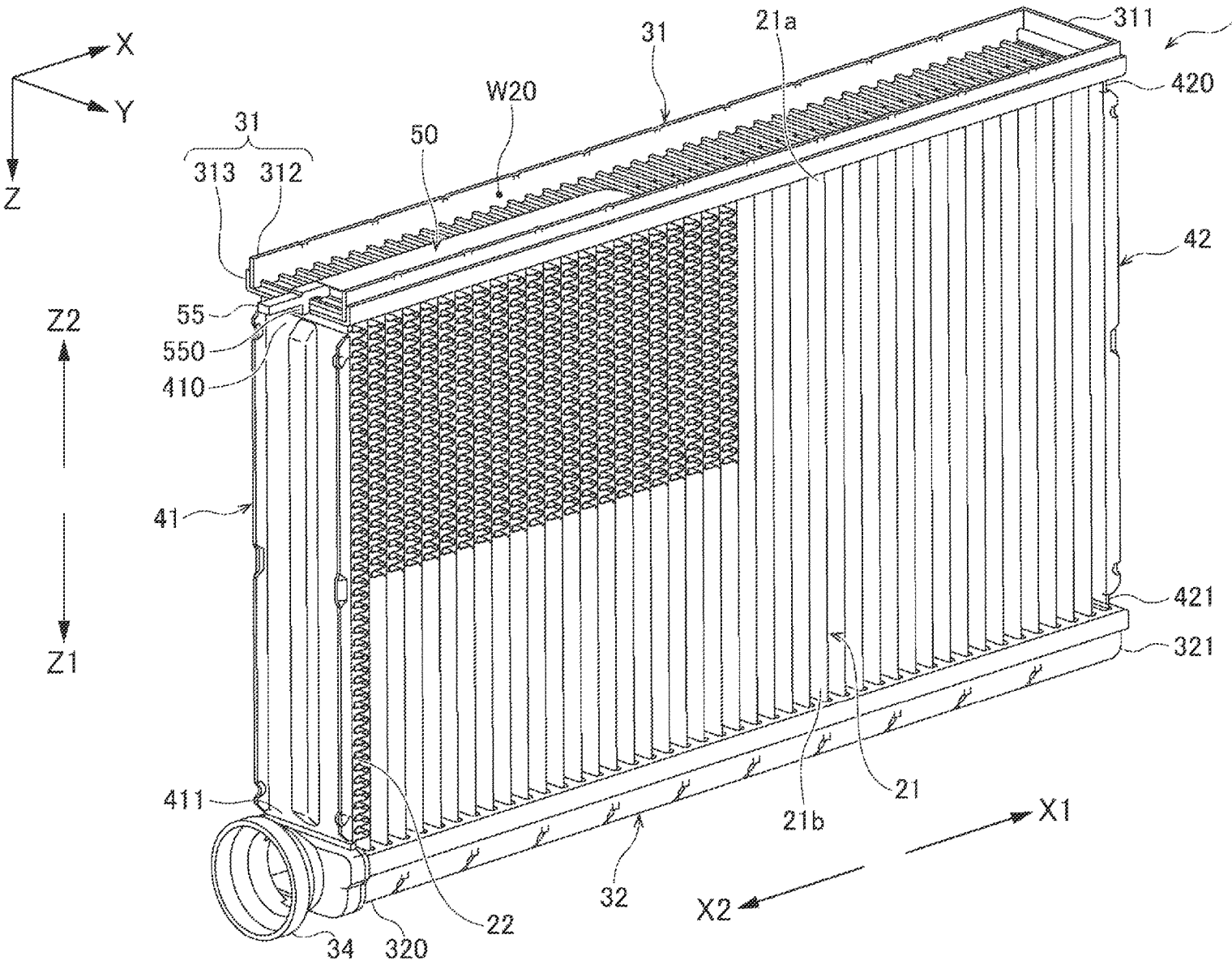
FIG. 4 is a perspective view illustrating a cut cross-sectional structure of the heat exchanger provided with a first tank member of the first tank cut along the cross section orthogonal to the tube longitudinal direction, according to the first embodiment.
Figure 5A:
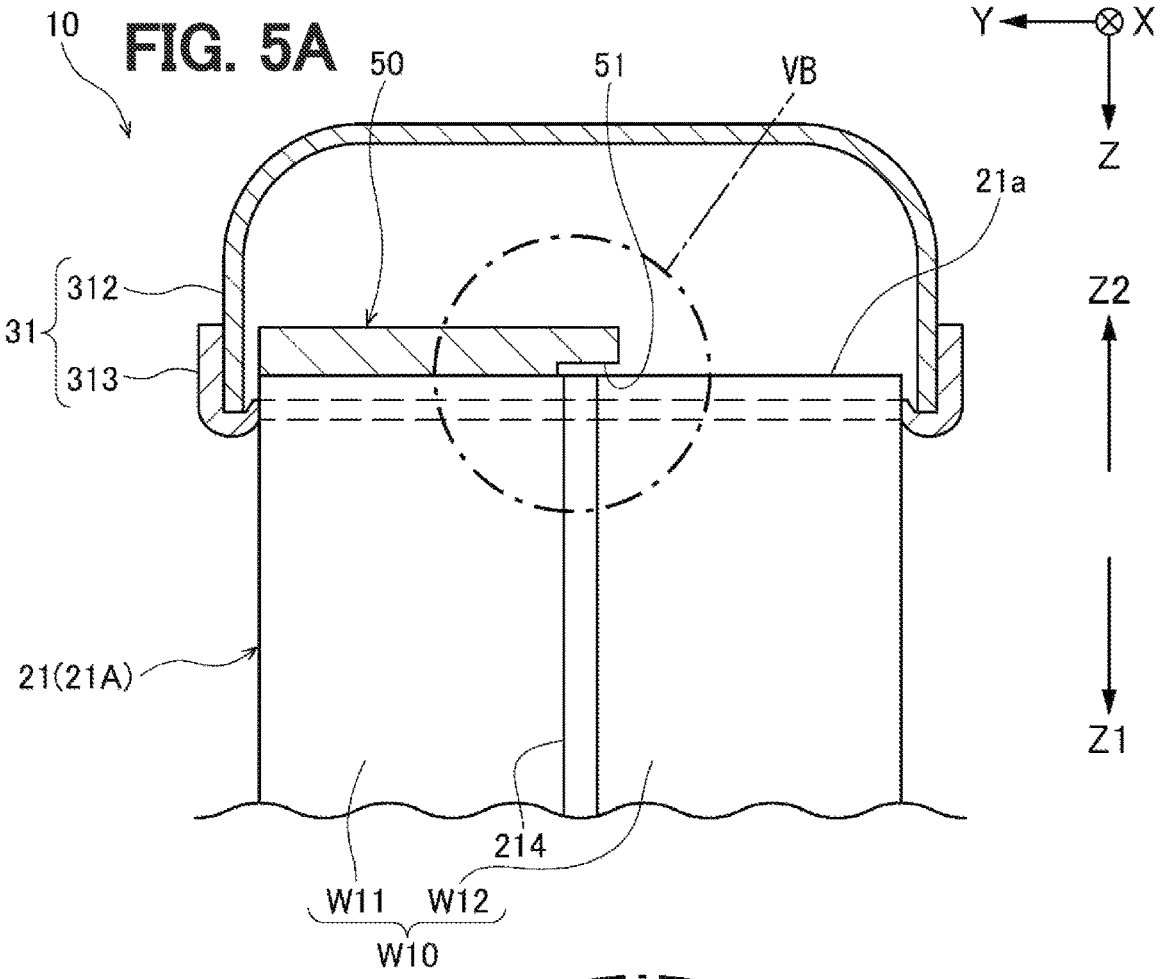
FIG. 5A is a cross-sectional view taken along a line VA-VA of FIG. 3.

The tanks 31, 32 are each a tubular member extending in the tube stacking direction X. The tanks include a first tank 31 and a second tank 32. As shown in FIG. 3 and FIG. 4, an inner passage W20 through which the cooling water flows is defined in the first tank 31. FIG. 4 shows a part of the fins 22. As shown in FIG. 5A, the first tank 31 includes a first tank member 312 and a second tank member 313. Shapes of the first tank member 312 and the second tank member 313 in cross section orthogonal to the tube stacking direction X are recessed. The first tank 31 is obtained by joining the first tank member 312 and the second tank member 313. As shown in FIGS. 3 to 5A, the first tank 31 is connected to one ends 21*a* of the tubes 21. The one ends 21*a* of the tubes 21 are arranged to extend through the second tank member 313 of the first tank 31 to the inner passage W20 of the first tank 31. As shown in FIG. 1, an inflow port 33 is attached to one end 310 of the first tank 31 that faces in the X2 direction. The other end 311 of the first tank 31 that faces in the X1 direction is closed.

Like the first tank 31, the second tank 32 is also a tubular member in which a flow path for the cooling water is formed. The second tank 32 is connected to the other ends 21*b* of the tubes 21. An outlet port 34 is attached to one end 320 of the second tank 32 that faces in the X2 direction. The other end 321 of the second tank 32 that faces in the X1 direction is closed.

Side plates 41, 42 are disposed different ends of the core 20 in the tube stacking direction X, respectively. One ends 410, 420 of the side plates 41, 42 in the Z2 direction are connected to the first tank 31. As shown in FIG. 3, one end 410 of a side plate 41 is arranged to extend through the second tank member 313 of the first tank 31 to the inner passage W20 of the first tank 31. Similarly, one end 420 of a side plate 42 is also connected to the first tank 31. Further, as shown in FIG. 1, the other ends 411, 421 of the side plates 41, 42 facing in the Z1 direction are connected to the second tank 32. The side plates 41, 42 are provided to reinforce the core 20.

As shown in FIGS. 3 to 5A, the heat exchanger 10 further includes a closing member 50 accommodated in the first tank 31. The closing member 50 is a member separate from the first tank 31, and is arranged inside the first tank 31 by being inserted into the first tank 31 from the inflow port 33. As shown in FIG. 6, the closing member 50 is formed into a flat plate shape. As shown in FIG. 3, the closing member 50 is provided at ends 21*a* of a predetermined number of the tubes 21 arranged near the inflow port 33. The closing member 50 partially closes openings provided at the ends 21*a* of the predetermined number of tubes 21. More specifically, the closing member 50 is provided to close openings of flow paths W11 at the ends 21*a* of the predetermined number of tubes 21. Hereinafter, for convenience, the tubes 21 which are arranged near the inflow port 33 and have flow paths partially closed by the closing member 50 are referred to as "predetermined tubes 21A". As shown in FIG. 3, an end of the closing member 50 that faces in the X2 direction has a protrusion 55 extending toward an inside of the inflow port 33. As shown in FIG. 4, a bottom surface of the protrusion 55 that faces in the Z1 direction has an engaging portion 550. The engaging portion 550 is engaged with an end face of the second tank member 313 of the first tank 31 that faces in the X2 direction. The engagement between the engaging portion 550 and the second tank member 313 of the first tank 31 limits a displacement of the closing member 50 in the X1 direction.

Next, an exemplary operation of the heat exchanger 10 of the present embodiment will be described.

In the heat exchanger 10, a liquid phase cooling water flows into the first tank 31 through the inflow port 33. The cooling water that has flowed into the first tank 31 is distributed to the tubes 21 by flowing into the inner passages W10 from the one ends 21*a* of the tubes 21. The cooling water distributed to the tubes 21 flows through the inner passages W10 of the tubes 21 toward the second tank 32. The heat exchanger 10 performs heat exchange between the cooling water flowing through the inner passages W10 of the tubes 21 and the air flowing outside the tubes 21. As a result, the air is heated by a heat of the cooling water transferred to the air. The cooling water that has passed through tubes 21 is collected in the second tank 32 and then discharged from the outlet port 34. As described above, the heat exchanger 10 of the present embodiment has a so-called all-pass type structure in which cooling water is distributed from the first tank 31 to all the tubes 21.

On the other hand, in the structure of the heat exchanger 10 in which the cooling water flows into the first tank 31 from the inflow port 33 provided at one end of the first tank 31 as shown in FIG. 3, a length of a flow path of the cooling water increases and a pressure loss of the cooling water increases as the cooling water flows toward the closed end 311. Therefore, a flow rate of the cooling water flowing into one of the tubes 21 arranged apart from the inflow port 33 becomes smaller than a flow rate of the cooling water flowing into another of the tubes 21 arranged near the inflow port 33. As a result, the flow rates of the cooling water of the tubes 21 may not be equal. If the flow rates of the cooling water of the tubes 21 become unequal, a temperature distribution in the air after heat exchange will not be uniform, which may lead to deterioration in comfort of an occupant of the vehicle.

In terms of this point, in the heat exchanger 10 of the present embodiment, since the openings of the one ends 21*a* of the predetermined tubes 21A are partially closed by the closing member 50, the pressure loss of the cooling water flowing into the predetermined tubes 21A can be increased. As a result, a difference between the pressure loss of the cooling water flowing into the predetermined tubes 21A of the tubes 21 and the pressure loss of the cooling water flowing into other tubes of the tubes 21 arranged apart from the inflow port 33 becomes small, so that it is possible to equalize the flow rates in the tubes 21.

Figure 5B:
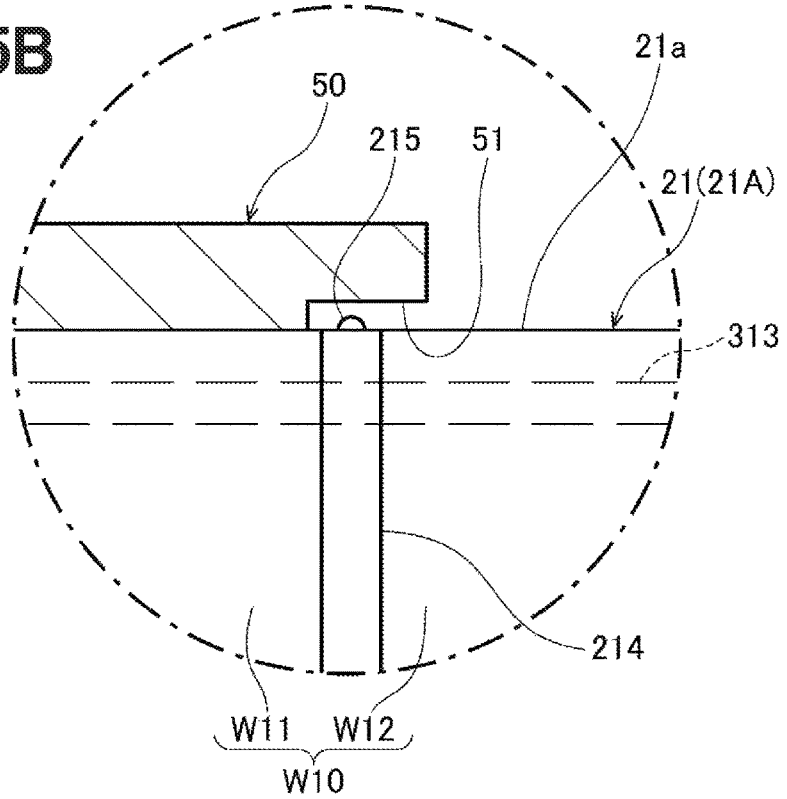
FIG. 5B is an enlarged view of a part VB of FIG. 5A.
Figure 6:
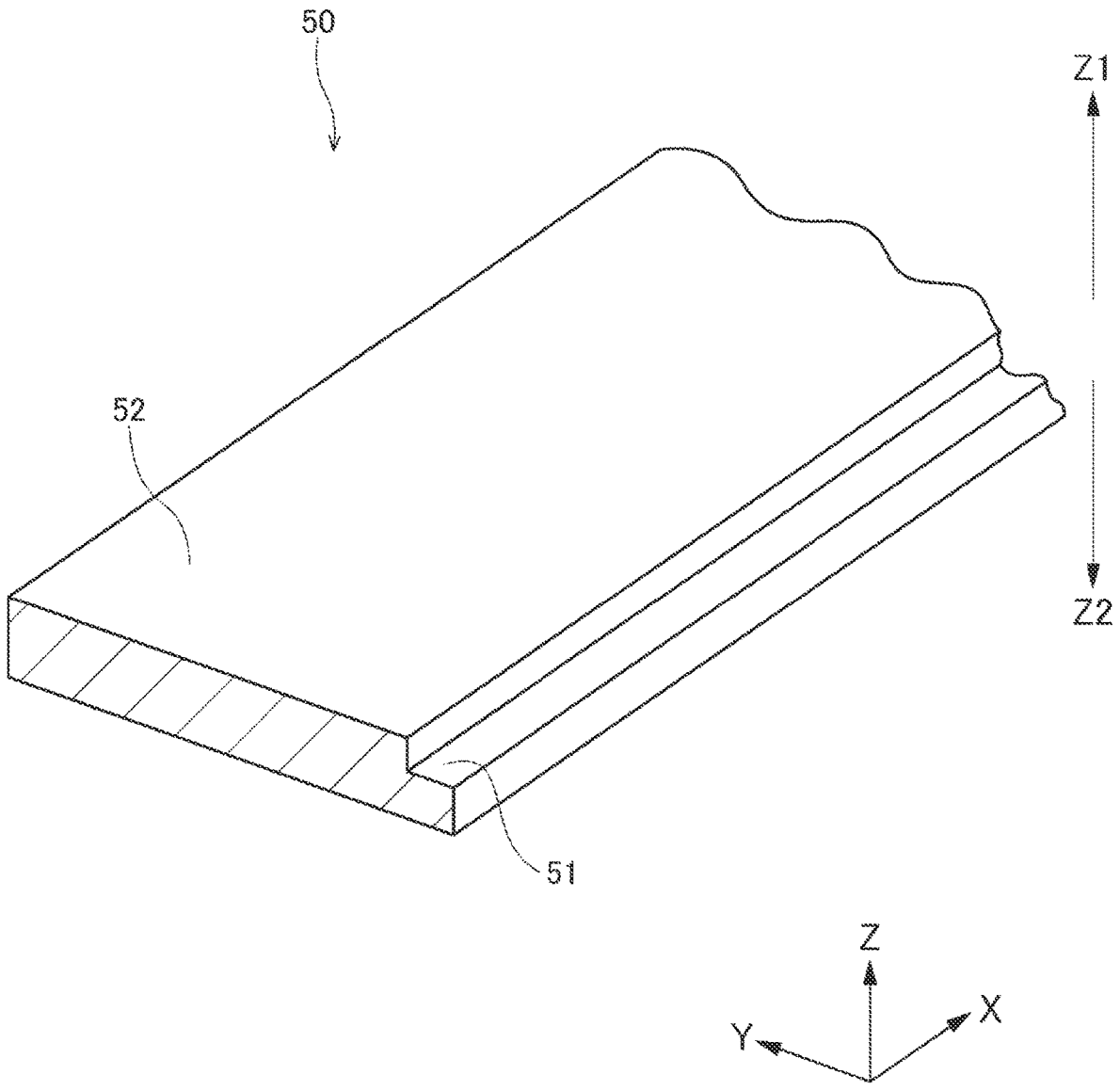
FIG. 6 is a perspective view illustrating a cross-sectional structure of a closing member of the first embodiment.

Further, it has been confirmed by the inventors that a protrusion 215 shown in an enlarged view in FIG. 5B is formed on one end 21*a* of a tube 21. The protrusion 215 is considered to be a burr or the like formed at the time of manufacturing the tube 21. Specifically, the tube 21 is manufactured by cutting the tubular product to the predetermined length as described above. A thickness of a portion of the tubular product corresponding to the joint 214 of the tube 21 is larger than a thickness of the other portions of the tubular product. At the joint 214 having such a large thickness, a burr is likely to occur at the time of cutting the tubular product. This causes formation of the protrusion 215 at the one end 21*a* of the tube 21.

Figure 7:
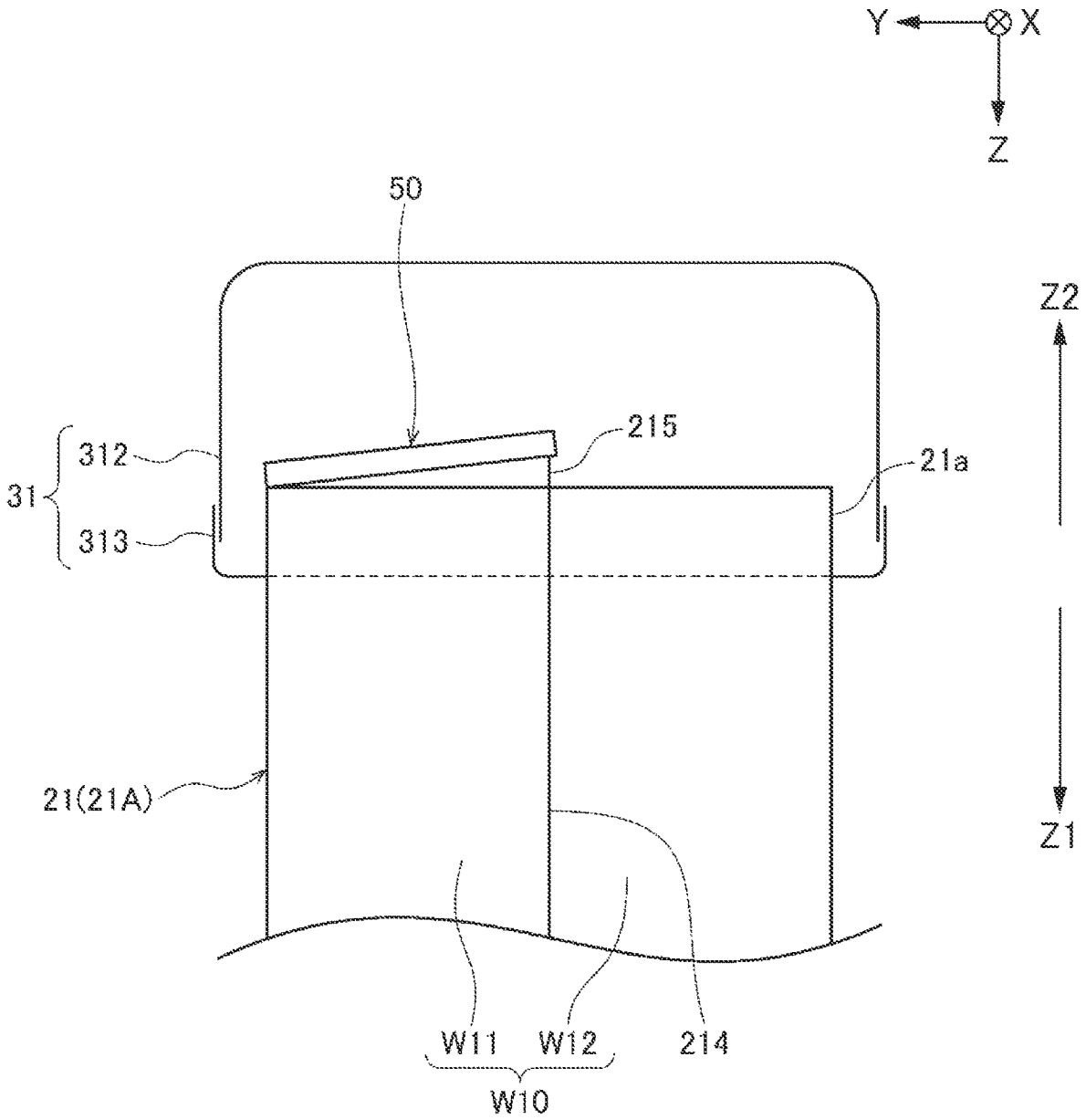
FIG. 7 is a cross-sectional view illustrating a cross-sectional structure of a first tank of a heat exchanger in cross section orthogonal to a tube longitudinal direction, according to a reference example.

If the closing member 50 is simply formed in a flat plate shape as shown in FIG. 7, the closing member 50 may be lifted by the protrusion 215 of the tube 21 at the time of placing the closing member 50 at the one end 21*a* of the tube 21. If a gap is formed between the one end 21*a* of the tube 21 and the closing member 50 by the lifting of the closing member 50, an effect of closing the openings by the closing member 50 decreases, so that it is difficult to equalize the flow rates of the tubes 21.

Therefore, as shown in FIGS. 5A and 5B, the closing member 50 of the present embodiment has a groove 51 is formed on a surface 52 of the closing member 50 facing the one ends 21*a* of the tubes 21. As shown in FIGS. 3 and 6, the groove 51 is formed to extend in the tube stacking direction X. Thus, as shown in FIG. 5A, when the closing member 50 is arranged at the one ends 21*a* of the predetermined tubes 21A, the protrusion 215 of the predetermined tubes 21A is located in the groove 51 of the closing member 50. As a result, interference between the closing member 50 and the predetermined tubes 21A can be avoided. Therefore, a part of the openings of the one ends 21*a* of the predetermined tubes 21A can be more reliably closed by the closing member 50. As described above, in the heat exchanger 10 of the present embodiment, the groove 51 corresponds to an avoiding structure for avoiding the interference between the protrusion 215 formed at the one ends 21*a* of the predetermined tubes 21A and the closing member 50.

According to the heat exchanger 10 of the present embodiment described above, actions and effects described in the following items (1) to (5) can be obtained.

(1) The groove 51 formed in the closing member 50 can avoid the interference between the protrusion 215 formed at the one ends 21*a* of the predetermined tubes 21A and the closing member 50. Thus, it becomes difficult for the closing member 50 to be lifted by the protrusion 215. As a result, the one ends 21*a* of the predetermined tubes 21A can be more certainly closed by the closing member 50, so that an effect obtained by providing the closing member 50, that is, an equality of distribution of the cooling water in the tubes 21 can be more reliably improved.

(2) If the protrusion 215 is formed at the one ends 21*a* of the tubes 21, the closing member 50 may collide with the protrusion 215 of the predetermined tubes 21A at the time of inserting the closing member 50 into the first tank 31 from the inflow port 33. As a result, it may be difficult to insert the closing member 50. However, since the groove 51 is formed on the closing member 50 as in the heat exchanger 10 of the present embodiment, the groove 51 can avoid the interference between the closing member 50 and the protrusion 215 of the predetermined tubes 21A, and the groove 51 functions as a guide for the insertion of the closing member 50. As a result, an ease of inserting the closing member 50 can be improved. Further, an inner wall surface of the first tank 31 faces one end of the closing member 50 in the air flow direction Y, and the protrusion 215 of the tube 21 faces the other end of the closing member 50 in the air flow direction Y. Displacement of the closing member 50 in the air flow direction Y can be limited.

(3) The groove 51 is formed on the surface 52 of the closing member 50 facing the one ends 21*a* of the predetermined tubes 21A as the avoiding structure for avoiding the interference between the protrusion 215 formed on the one ends 21*a* of the predetermined tubes 21A and the closing member 50. According to this configuration, the avoiding structure can be easily formed on the closing member 50.

(4) The closing member 50 is provided to partially close the one ends 21*a* of the predetermined tubes 21A. The closing member 50 has the groove 51 extending along protrusions 215 formed on the ends of the predetermined tubes 21A. According to this configuration, the one ends 21*a* of the predetermined tubes 21A can be closed by one closing member 50, and interference between the closing member 50 and the protrusions 215 can be avoided.

(5) The tubes 21 each include the metal plate 210 bent into the tubular shape, and the metal plate 210 has the joint 214 at which both ends 212, 213 of the metal plate 210 are joined to a the central portion of the metal plate 210. Since the tubes 21 having such a structure is likely to have the protrusion 215 made of a burr or the like at the joint 214, there is a great significance in use of the above-described structure of the closing member 50 as in the present embodiment.

Modification

Next, a modification of the heat exchanger 10 of the first embodiment will be described.

Figure 8:
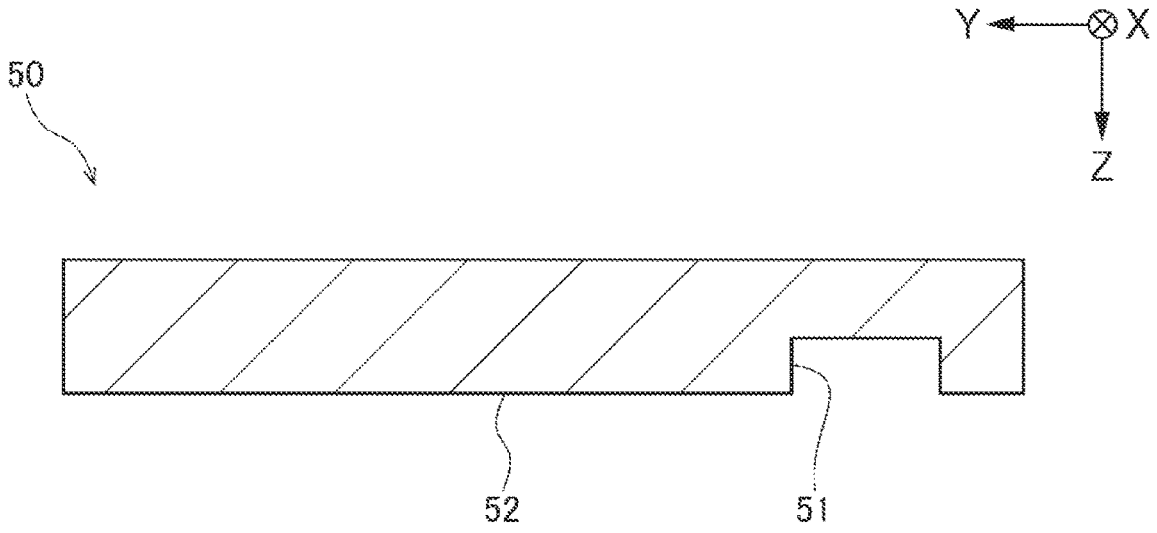
FIG. 8 is a cross-sectional view illustrating a cross-sectional structure of a closing member according to a modification of the first embodiment.
Figure 9:
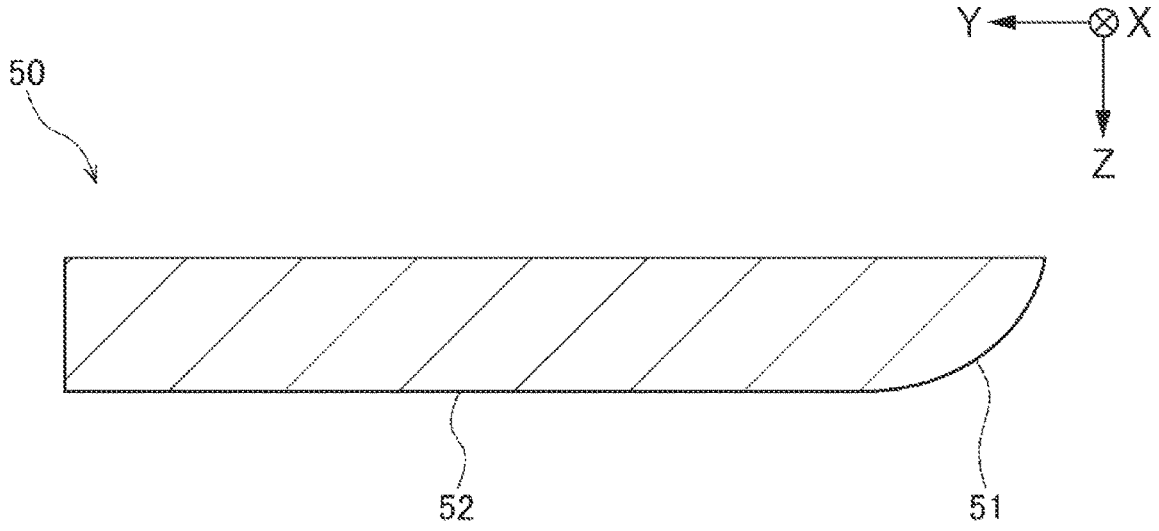
FIG. 9 is a cross-sectional view illustrating a cross-sectional structure of a closing member according to a modification of the first embodiment.

The shape of the groove 51 formed on the closing member 50 can be changed appropriately. For example, as shown in FIG. 8, the shape of the groove 51 in cross section orthogonal to the tube stacking direction X may be a recessed shape. Further, the groove 51 is not limited to a right-angle step as shown in FIG. 6, and may be formed in a convex curved shape as shown in FIG. 9.

Figure 10:
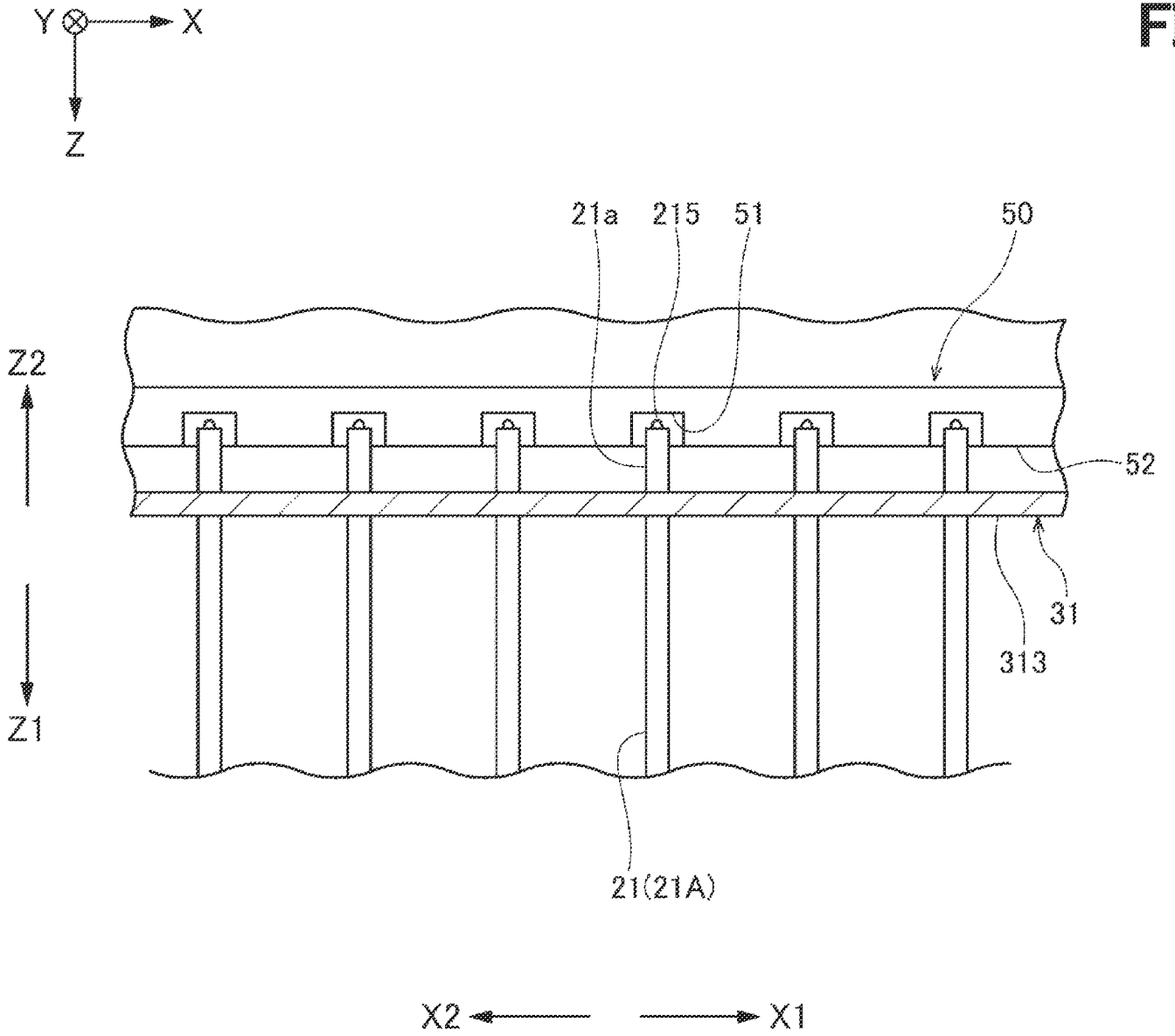
FIG. 10 is a cross-sectional view illustrating a cross-sectional structure of a first tank of a heat exchanger on a cross section orthogonal to an air flow direction, according to a modification of the first embodiment.

Further, as shown in FIG. 10, the groove 51 of the closing member 50 may be one of grooves 51 corresponding to the protrusion 215 at the one ends 21*a* of the predetermined tubes 21A. According to such a configuration, it is possible to secure a strength of the closing member 50 compared with the case where the groove 51 is formed into an elongated hole shape shown in FIG. 6.

Second Embodiment

Next, a heat exchanger 10 of a second embodiment will be described. Hereinafter, differences from the heat exchanger 10 of the first embodiment will be mainly described.

Figure 11:
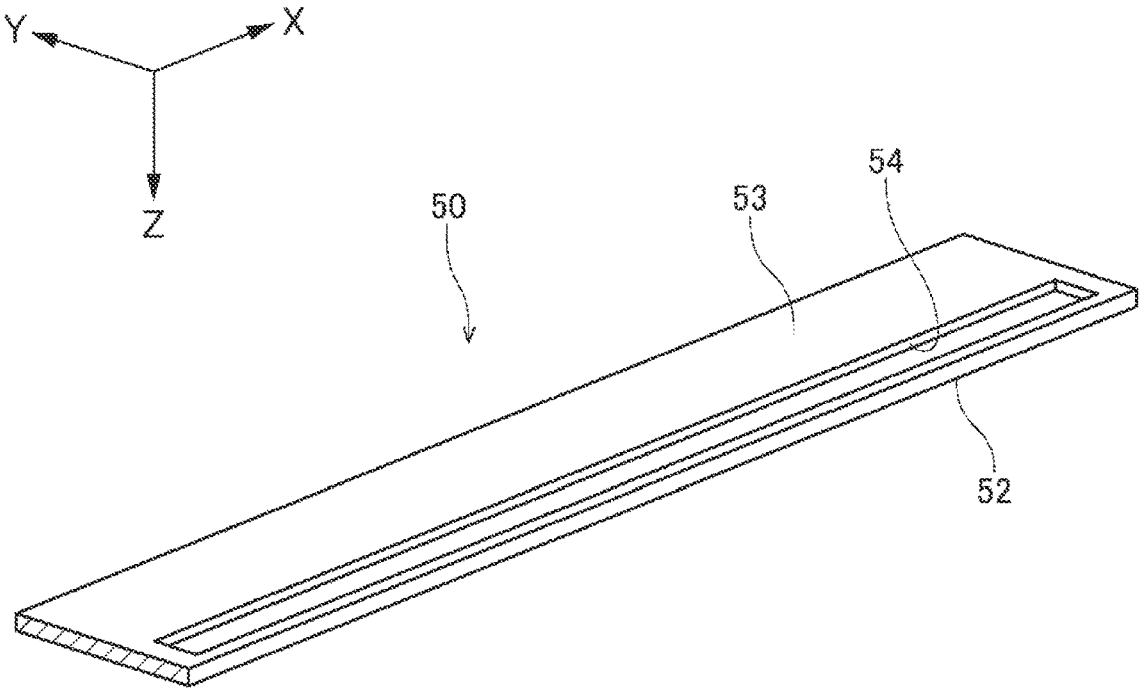
FIG. 11 is a perspective view illustrating a closing member of a second embodiment.

As shown in FIG. 11, a closing member 50 of the present embodiment has a through hole 54 passing through the closing member 50 from a surface 52 facing one ends 21*a* of tubes 21 to another surface 53 facing away from the one ends 21*a* of the tubes 21. The through hole 54 is an elongated hole extending in the tube stacking direction X. Thus, when the closing member 50 is arranged at one ends 21*a* of predetermined tubes 21A, the protrusion 215 of the predetermined tubes 21A can be located in the through hole 54 of the closing member 50. As a result, interference between the closing member 50 and the predetermined tube 21A can be avoided. Therefore, a part of the openings of the one ends 21*a* of the predetermined tubes 21A can be more reliably closed by the closing member 50.

According to the heat exchanger 10 of the present embodiment described above, actions and effects same as or similar to those of the heat exchanger 10 of the first embodiment can be obtained.

Modification

Next, a modification of the heat exchanger 10 of the second embodiment will be described.

Figure 12:
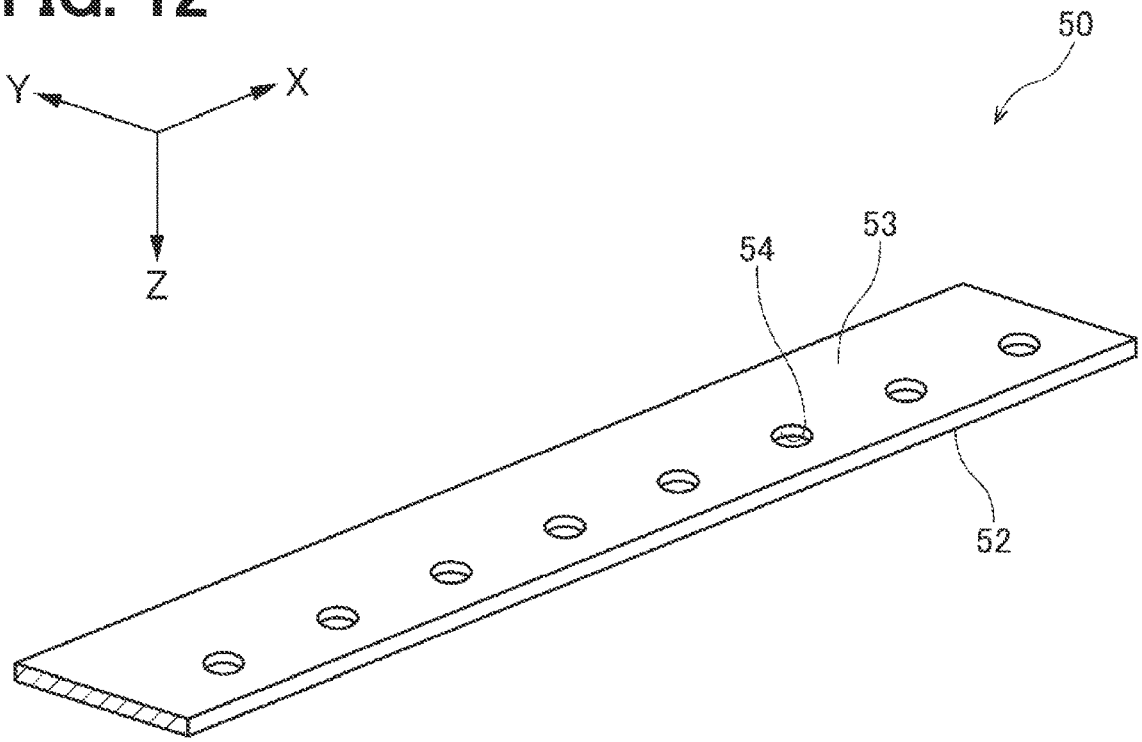
FIG. 12 is a perspective view illustrating a closing member of a modification of the second embodiment.

The shape of the through hole 54 formed on the closing member 50 can be changed appropriately. For example, as shown in FIG. 12, the through hole 54 of the closing member 50 may be one of through holes 54 corresponding to protrusions 215 at the one ends 21*a* of the predetermined tubes 21A. According to such a configuration, it is possible to secure a strength of the closing member 50 compared with the case where the through hole 54 is the elongated hole shown in FIG. 11.

Other Embodiments

The preceding embodiments may be practiced in the following modes.

The closing member 50 is not limited to a closing member closing the one ends 21*a* of the tubes 21, but may also close one end 21*a* of one tube 21. That is, the closing member 50 may be any closing member as long as the closing member partially closes an opening provided at an end of at least one of the tubes 21.

The closing member 50 is not limited to a closing member closing tubes arranged near the inflow port 33, and may be any closing member that closes one end 21*a* of an arbitrary tube 21.

In the heat exchanger 10 of each embodiment, the closing member 50 may be provided not in the first tank 31 but in the second tank 32, and partially close openings of the other ends 21*b* of the tubes 21.

The heat exchanger 10 of each embodiment is not limited to the heater core of the air conditioner, and can be applied to an arbitrary heat exchanger.

The present disclosure is not limited to the above specific examples. Those skilled in the art may appropriately modify the above described specific examples, and these modifications are also included in the scope of the present disclosure as long as they have the features of the present disclosure. Each element included in each of the specific examples described above, and the placement, condition, shape, and the like of the element are not limited to those illustrated, and can be modified as appropriate. The elements included in each of the specific examples described above can be appropriately combined as long as there is no technical contradiction.

The invention claimed is:

1. A heat exchanger including tubes arranged side by side, and a tank connected to ends of the tubes, the heat exchanger performing heat exchange between a first fluid flowing inside the tubes and a second fluid flowing outside the tubes, the heat exchanger comprising a closing member that is a flat plate disposed inside the tank and partially closing an opening provided at an end of a predetermined tube that is at least one of the tubes, wherein the predetermined tube has a protrusion formed at the end of the predetermined tube, the closing member has an avoiding structure that avoids interference between the protrusion and the closing member, the avoiding structure is a groove or a through hole, the opening includes a first opening and a second opening arranged in an air flow direction, and the closing member covers an entire area of the first opening.

2. The heat exchanger according to claim 1, wherein the avoiding structure is the groove formed on a surface of the closing member facing the end of the predetermined tube.

3. The heat exchanger according to claim 2, wherein the predetermined tube is one of predetermined tubes having ends with openings partially closed by the closing member, and the groove extends along protrusions formed on the ends of the predetermined tubes.

4. The heat exchanger according to claim 2, wherein the predetermined tube is one of predetermined tubes having ends with openings partially closed by the closing member, and the groove is one of grooves corresponding to protrusions formed on the ends of the predetermined tubes.

5. The heat exchanger according to claim 1, wherein the avoiding structure is the through hole formed in the closing member such that the through hole passes through the closing member from one surface facing the end of the predetermined tube to another surface facing away from the end of the predetermined tube.

6. The heat exchanger according to claim 5, wherein the predetermined tube is one of predetermined tubes having ends with openings partially closed by the closing member, and the through hole extends along protrusions formed on the ends of the predetermined tubes.

7. The heat exchanger according to claim 5, wherein the predetermined tube is one of predetermined tubes having ends with openings partially closed by the closing member, and the through hole is one of through holes corresponding to protrusions formed on the ends of the predetermined tubes.

8. The heat exchanger according to claim 1, wherein the tubes include a metal plate bent into a tubular shape, and the metal plate has a joint at which both ends of the metal plate are joined to a central portion of the metal plate.

9. The heat exchanger according to claim 1, wherein the predetermined tube has a partition plate separating the first opening and the second opening.

* * * * *